US008550768B2

(12) United States Patent
Montgomery

(10) Patent No.: US 8,550,768 B2
(45) Date of Patent: Oct. 8, 2013

(54) METHOD FOR IMPROVING THE STALL MARGIN OF AN AXIAL FLOW COMPRESSOR USING A CASING TREATMENT

(75) Inventor: Matthew D. Montgomery, Jupiter, FL (US)

(73) Assignee: Siemens Energy, Inc., Orlando, FL (US)

( * ) Notice: Subject to any disclaimer, the term of this patent is extended or adjusted under 35 U.S.C. 154(b) by 658 days.

(21) Appl. No.: 12/795,781

(22) Filed: Jun. 8, 2010

(65) Prior Publication Data

US 2011/0299979 A1 Dec. 8, 2011

(51) Int. Cl.
*F04D 27/02* (2006.01)

(52) U.S. Cl.
USPC ..... 415/1; 415/57.1

(58) Field of Classification Search
USPC ..... 415/1, 57.1, 57.3, 57.4, 58.2, 58.6, 415/58.7, 914; 703/9; 702/35, 179, 138
See application file for complete search history.

(56) References Cited

U.S. PATENT DOCUMENTS

| | | | | |
|---|---|---|---|---|
| 6,619,909 | B2 * | 9/2003 | Barnett et al. | 415/57.4 |
| 7,575,412 | B2 * | 8/2009 | Seitz | 415/58.5 |
| 8,257,022 | B2 * | 9/2012 | Guemmer | 415/58.6 |
| 2002/0041805 | A1 * | 4/2002 | Kurokawa et al. | 415/119 |
| 2008/0044273 | A1 * | 2/2008 | Khalid | 415/57.4 |

OTHER PUBLICATIONS

Xudong Huang, Haixin Chen, Song Fu; "CFD Investigation on the Circumferential Grooves Casing Treatment of Transonic Compressor"; Proceedings of ASME Turbo Expo 2008—Power for Land, Sea and Air; Jun. 9-13, 2008; 9 pgs; GT2008-51107; Berlin, Germany.

Victor Mileshin, Igor Brailko, Andrew Startsev; "Application of Casing Circumferential Grooves to Counteract the influence of Tip Clearance"; Proceedings of ASME Turbo Expo 2008—Power for Land, Sea and Air; Jun. 9-13, 2008; 11 pgs; GT2008-51147; Berlin, Germany.

Martin W. Mueller, Christoph Biela, Heinz-Peter Schiffer, Chunill Hah; "Interaction of Rotor and Casing Treatment Flow in an Axial Single-Stage Transonic Compressor with Circumferential Grooves"; Proceedings of ASME Turbo Expo 2008—Power for Land, Sea and Air; Jun. 9-13, 2008; 11 pgs; GT2008-50135; Berlin, Germany.

Aamir Shabbir, John J. Adamczyk; "Flow Mechanism for Stall Margin Improvement Due to Circumferential Casing Grooves on Axial Compressors"; Proceedings of ASME Turbo Expo 2004—Power for Land, Sea and Air; Jun. 14-17, 2004; 13 pgs; GT2004-53903; Vienna, Austria.

Vitaliy Yu; "Development of New Casing Treatment Configuration"; JSME International Journal; Jul. 14, 2004; pp. 804-812; Series B, vol. 47, No. 4, 2004.

D. C. Rabe, C. Hah; "Application of Casing Circumferential Grooves for Improved Stall Margin in a Transonic Axial Compressor"; Proceedings of ASME Turbo Expo 2002; Jun. 3-6, 2002; 13 pgs; GT-2002-30641; Amsterdam, The Netherlands.

* cited by examiner

*Primary Examiner* — Edward Look
*Assistant Examiner* — Nercy Moreno-Nerey

(57) ABSTRACT

A method for determining a preferred circumferential groove arrangement for a casing treatment of an axial flow compressor is disclosed. The method includes using the results from a three dimensional steady state computational fluid dynamic analysis to generate a flow field between a blade tip of a rotating blade and a compressor casing to determine the preferred circumferential groove arrangement. A stall margin for the axial flow compressor will be increased with the method.

18 Claims, 9 Drawing Sheets

METHOD FOR IMPROVING THE STALL MARGIN OF AN AXIAL FLOW COMPRESSOR USING A CASING TREATMENT

TECHNICAL FIELD

This disclosure relates generally to axial flow compressors in industrial gas turbine engines and more specifically to a plurality of axially spaced circumferential grooves of varying groove depth machined into a compressor casing wall and arranged above at least one of the first two rows of rotating compressor blades.

BACKGROUND

An axial flow compressor of a gas turbine engine is a multi-stage element that performs work on a fluid, which is typically air, by increasing the pressure of the fluid as it moves through the compressor traveling to a combustion element where the now energized fluid is mixed with a fuel and combusted, and then expanded in a turbine element. The compressor comprises a rotor mounted between at least two bearings and rotates within a compressor casing, which serves as a pressure vessel to contain the energized fluid. The rotor carries a plurality of rotating blades arranged in rows with each rotating blade having an airfoil-shaped cross-section. Interleaved between the rows of rotating blades are rows of stationary blades disposed on the casing wall. Each stage consists of a row of rotating blades followed by a row of stationary blades. As is well known, fluid flow in a multi-stage axial flow compressor is complex by nature because of the proximity of the rotating blades, the buildup of end-wall boundary layers, and the presence of tip leakage flows and secondary flows. All compressors have a limit of stable operation. Beyond this limit the compressor cannot sustain a stable flow pattern, and thus the compressor is not useable.

The compressor is designed for stable operation at a variety of design points, which vary in mass flow and pressure within a design envelope. FIG. 1 illustrates a typical compressor performance map 11, which is a plot of pressure ratio 12 as a function of mass flow 13. Pressure ratio 12 is understood by the skilled artisan to be the ratio of a static or total pressure at the exit of the stage to a total inlet pressure of the stage. When the compressor is operating within the design envelope, the compressor is typically operating along a working line 14, with the working line being comprised of a plurality of design points 16. Design points 16 represent the intersection of the working line 14 with a particular mass flow 13. When the compressor is operating within the design envelope, the air flow through the compressor is essentially uniform and stable around the compressor annulus.

If the compressor is operated too close to a peak pressure rise, disturbances acting on the compressor can cause it to encounter a region where fluid dynamic instabilities, known as rotating stall, develop. On the compressor performance map 11 of FIG. 1, this region of peak pressure rise is illustrate as the region above the working line 14 and bounded by a stall line 18, which is the point where rotating stall will occur for a particular mass flow 13. Additionally, the fluid dynamic instabilities degrade the performance of the compressor and can lead to permanent damage and should be avoided.

Rotating stall results in a localized region of reduced or reversed flow that rotates around the annulus of the flow path and through the compressor. The region is termed as a "stall cell" and typically extends axially through the compressor. Rotating stall results in reduced output from the compressor, can affect only one stage or a group of stages, can lead to a complete fluid flow breakdown through the compressor, and cause a drop in the expected compressor performance or the compressor being loaded in a condition beyond its design. Furthermore, as the stall cell rotates around the annulus of the compressor, it loads and unloads the compressor blades and vanes and can induce fatigue failure.

In many cases, and depending on the operating regime of the compressor, the compressor blades are critically loaded without the capacity, or margin, to absorb the disturbance resulting from the rotating stall. Oftentimes, the stall cells can affect neighboring regions and the stalled region can rapidly grow to become a complete compressor stall that produces catastrophic results to the compressor components. Thus, a compressor must be designed to have a safety margin between the fluid flow and compression ratio at which it will normally be operated and the fluid flow and compression ratio at which a rotating stall will occur. In practical applications, the closer the operating point is to the peak pressure rise, the less the system can tolerate a given disturbance level without entering rotating stall. As a result of the instabilities, compressors are typically operated with the safety margin, or "stall margin." With continued reference to FIG. 1, the stall margin 19 is a measure of the ratio between peak pressure rise 21, i.e. a pressure rise at stall, and the pressure ratio 22 on the working line 14 of the compressor for a particular flow rate 23. In theory, the greater the stall margin 19, the larger the disturbance the compressor can tolerate before entering rotating stall.

One way of increasing the stall margin for a compressor is through the use of a casing treatment. Generally, the casing treatment modifies the fluid flow at a tip region of the rotating compressor blades by physically altering a wall of the casing. One such alteration is to machine a circumferential air channel or groove in the casing wall proximate the tip region of the rotating blades. With the circumferential grooves applied to the casing wall, the stall cells that prevail when the gas turbine is operating at or near the stall point are encouraged to migrate circumferentially around the casing annulus at the blade tip of the rotating row of blades. Thus, the casing treatment provides a means for the fluid to exit the flow-path where the rotating blade loading is severe and the local pressure ratio high, travel circumferentially around the casing annulus, and re-enter the flow-path at a location where the pressure is more moderate thereby reducing the potential of a tip leakage vortex developing.

At the tip of the rotating compressor blades, a pressure gradient between a pressure side and a suction side of the rotating blade generates a secondary flow that is referred to as tip leakage flow, which is fluid flow passing through a clearance gap between the rotating blade tip and the compressor casing. The tip leakage flow can cause a phenomenon known as a tip leakage vortex to develop, and the behavior of this vortex can promote rotating stall. The tip leakage vortex can extend along the blade to blade passage until it impacts the pressure side of an adjacent blade and disturbs the main flow and affects overall stage performance. With a casing treatment, the tip leakage vortex is essentially sucked into the treated region to reduce a tip region blockage and increase the stall margin. The tip region blockage is caused by a locally high pressure. Thus, a casing wall having circumferential grooves can provide a substantial improvement in the compressor stall margin when compared to a smooth casing wall.

However, an inverse relationship exists between the increase in stall margin that results from application of the casing treatment and the overall compressor efficiency, i.e. improving stall margin via the casing treatment generally causes a reduction in compressor performance. This is largely due to an increase in the tip leakage flow that arises from the casing material being removed by machining the grooves, which increases the flow area above the blade tip. Furthermore, current industrial practices are such that machining a circumferential groove geometry into the casing can be a function of machining capability, rather than aerodynamic and performance considerations. For example, for a given plurality of axially spaced grooves, it can be desirable to have shallow circumferential grooves arranged in the casing above the leading edge of the blade tip. This is because local regions having a high pressure and tip leakage vortices tend to develop toward the trailing edge of the blade tip. Implementing shallow circumferential grooves in the casing near the leading edge of the blade tip would reduce the tip leakage flow when compared to an array of axially spaced grooves machined to the same groove depth. In fact, in some cases, grooves may not be required at all in the casing above the leading edge of the blade. Therefore, tailoring a groove profile or groove geometry for a plurality of axially spaced circumferential grooves to the flow physics at the blade tip can reduce tip leakage losses when compared to traditional approaches, reduce the negative impact of the grooves to compressor performance, and increase stall margin. Accordingly, a need exists for a method of determining a preferred groove geometry for a plurality of axially spaced grooves for a compressor casing treatment to circulate near stagnant air above the blade tip thereby increasing the stall margin of the compressor and offering a greater envelope of reliable operation.

SUMMARY

Briefly described, the invention comprises a method for improving the stall margin of an axial flow compressor while minimizing a penalty in a compressor performance. In broad terms, the method is an iterative process that involves analytically conducting a baseline performance analysis of a rotating row of compressor blades with a compressor casing having a smooth wall. The baseline performance analysis includes a baseline aerodynamic performance analysis and a baseline stall margin calculation. Once the baseline performance analysis is complete, a set of baseline results will be compared to a set of results from a subsequent performance analysis. The subsequent performance analysis will include the effects of a circumferential groove modeled in the compressor casing.

To determine the baseline aerodynamic performance, a performance calculation is performed at a design point of the compressor. As discussed above and in connection with FIG. 1, design points are located at the intersection of the working line and a particular mass flow. The rotating row of compressor blades is also analyzed at an off-design point. As shown in FIG. 1, off-design points are any operating points on the compressor map that are not design points. The results from the calculation at the off-design point are used to generate a flow field between a tip region of the rotating blade and the smooth wall of the casing. A baseline stall margin for the rotating row of blades is determined from the results of the baseline performance analysis at the off-design point. The baseline aerodynamic performance and the baseline stall margin for the row of blades are the reference calculations that future iterative analytical calculations will be compared against.

From the flow field at the off design point, regions between adjacent blades where the tip leakage flow has a high pressure ratio are identified. Regions of tip leakage flow having a high pressure ratio are an indication that the fluid flow is stagnant and the rotating blades can be approaching conditions for rotating stall to ensue. These regions are the locations where an analyst would consider placing circumferential grooves in the smooth wall of the casing to alleviate the stagnant tip leakage flow. Initially, a single circumferential groove can be analytically modeled in the smooth wall of the compressor casing. However, it is not required that a single circumferential groove be analytically modeled in the smooth wall and multiple grooves can be modeled if interpretation of the flow field warrants such a configuration. The characteristics of the circumferential groove, such as groove depth, groove width, and axial placement of the groove relative to the leading and trailing edge of the blade are determined from evaluation of the flow field.

A subsequent performance analysis is next performed for the row of blades. The subsequent performance analysis will includes the effects of the modeled circumferential groove in the compressor casing wall. In the subsequent performance analysis, a subsequent aerodynamic performance is analytically calculated at the design point. Additionally, as part of the subsequent performance analysis, a subsequent stall margin at the off-design point is analytically calculated. The subsequent aerodynamic performance at the design point and the subsequent stall margin at the off design point are then compared to the baseline aerodynamic performance and the baseline stall margin, respectively. If the subsequent aerodynamic performance and the subsequent stall margin satisfy an acceptance criteria, then the casing treatment analysis is complete and the evaluated groove geometry and is machined into the casing wall.

However, if the acceptance criteria is not met, at least one of a plurality of parameters that establish the groove geometry are adjusted; and a subsequent performance analysis is again performed. The plurality of groove parameters include, but are not limited to: a groove depth; a groove width; the number of grooves; the depth of successive grooves in a groove arrangement; the cross section of the groove; the distance the groove is placed from the leading edge of the rotating row of blades; and a distance the groove is placed from the trailing edge of the rotating row of blades.

With the geometry of the circumferential groove adjusted, a subsequent aerodynamic performance at the design point and a subsequent stall margin at the off-design point are calculated and again compared to the baseline aerodynamic performance and the baseline stall margin, respectively. This iterative process is continued until the acceptance criteria has been satisfied. Once the acceptance criteria is satisfied, the groove geometry satisfying the criteria is considered to be a preferred groove geometry and can be applied to the casing.

The acceptance criteria will typically have two components. The first component of the criteria is an acceptable increase in stall margin achieved with placement of at least one circumferential groove in the casing. An acceptable increase in stall margin can be an increase of at least 5% when compared to the baseline stall margin. One typically is not looking for an increase versus the baseline, but rather an absolute stall margin for the design, which may be 25% at the design speed or 10% at the lowest operating speed. The second component of the acceptance criteria is to what extent placement of the at least one circumferential groove in the compressor casing wall will have on aerodynamic performance of the blades. It is known that placing the circumferential groove in the compressor casing wall will negatively impact the aerodynamic performance due to an increased tip leakage flow caused by the casing material removed for the circumferential groove. Therefore, there is a balance between the increase in stall margin and the decrease in aerodynamic performance that is to be achieved. Typically, a decrease in aerodynamic performance of no more that 0.1% in stage efficiency is acceptable. In this process, it can be that only satisfying the acceptance criteria for stall margin is desired. This is because it can be beneficial to satisfy the acceptance criteria to increase stall margin thereby expanding the operating envelope but at the expense of a penalty in aerodynamic performance. It can also be that the increased stability margin provided by the circumferential groove, or grooves, allows for a redesign of the airfoil section to reduce the size of the airfoil, which achieves the desired pressure rise. The use of a smaller (i.e. reduced airfoil cross section, chord, or thickness) airfoil may increase the stage efficiency, thereby offsetting a penalty due to the increased tip leakage flow because of the circumferential groove, or grooves.

Another aspect of this disclosure includes a gas turbine engine having a compressor with circumferential grooves arranged in the compressor casing above at least the first or second rows of rotating compressor blades. Because of the circumferential grooves, the compressor has an improved stall margin and placement of the circumferential grooves is determined using the method as disclosed.

These and other features, objects, and advantages will be better understood upon review of the detailed description presented below taken in conjunction with the accompanying drawing figures, which are briefly described as follows.

DESCRIPTION OF THE DRAWINGS

According to common practice, the various features of the drawings discussed below are not necessarily drawn to scale. Dimensions of various features and elements in the drawings may be expanded or reduced to illustrate more clearly the embodiments of the disclosure.

DETAILED DESCRIPTION

The invention described herein employs several basic concepts. For example, one concept relates to a method of determining an improved compressor casing groove arrangement using a set of results from a three dimensional (3D) steady state computational fluid dynamic (CFD) analysis that includes viscous effects of a working fluid. Another concept relates to a method of increasing the stall margin at an off design operating point for a compressor of a gas turbine engine. Yet another concept relates to a design of a more efficient rotating compressor blade due to the increase in compressor stall margin realized from the compressor casing treatment.

The present invention is disclosed in context of use as a method for determining an improved casing groove arrangement in the compressor casing based on the examination of a flow field created from a 3D CFD analysis of an axial flow compressor performed at an off-design point of operation. It is understood that any reference to a 3D CFD analysis within this document is meant to be a 3D CFD steady state analysis that includes the viscous effects of the working fluid. The principles of the present invention are not limited to use within a gas turbine or a steam turbine, or for determining an improved casing groove configuration. For example, this method could be used in other machinery or structures wherein a stall phenomenon is known and a 3D CFD analysis can be performed, such as impellers and centrifugal compressors. However, one skilled in the art may find additional applications for the apparatus, processes, systems, components, configurations, methods and applications disclosed herein. Thus, the illustration and description of the present invention as disclosed in the context of an exemplary method for determining an improved casing treatment, is merely one possible application of the present invention.

Figure 2:
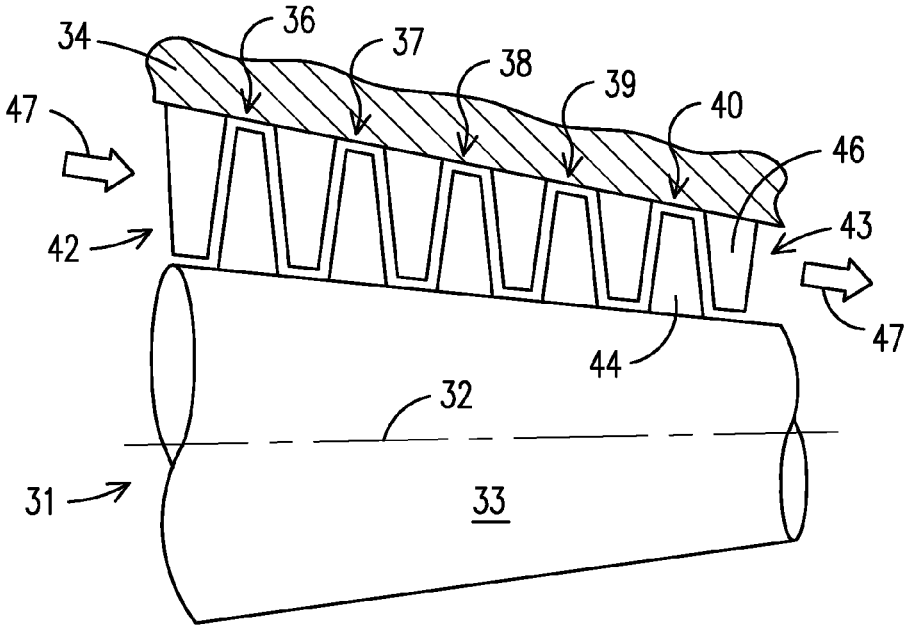
FIG. 2 is a schematic illustration of a cross section of a conventional axial flow compressor for use in a gas turbine engine.

Referring now in more detail to the drawing figures, wherein like reference numerals indicate like parts throughout the several views, FIG. 2 is a schematic illustration of a typical axial flow compressor 31 used in a gas turbine engine. For clarity of discussion, the following three directional definitions are commonly used when discussing turbomachinery and are used throughout this application. (1) Axial refers to the direction parallel to a rotor axis 32, pointing in the downstream direction. (2) Radial refers to the direction orthogonal to the rotor axis 32 pointing outward from the axis. (3) Tangential (also referred to as circumferential) points in the direction of blade rotation. The axial flow compressor element 31 includes a rotor 33, which is arranged concentrically within a compressor casing 34, and rotatable about the rotor axis 32. The compressor casing 34 is arranged radially outwardly from the rotor axis 32 and defines a generally cylindrical flow passage. The compressor element 31 has a plurality of compressor stages 36, 37, 38, 39, 40 which are arranged one behind the other in the axial direction between a compressor inlet 42 and a compressor outlet 43. The stages 36, 37, 38, 39, 40 comprise in each case a ring of rotor blades or rotating blades 44 and a ring of stator blades 26. A fluid 47, which is typically air, flows through the axial compressor from the compressor inlet 42 to the compressor outlet 43 and exits the compressor element 31 as a compressed, energized fluid to be received by a combustion element (not shown).

Figure 3:
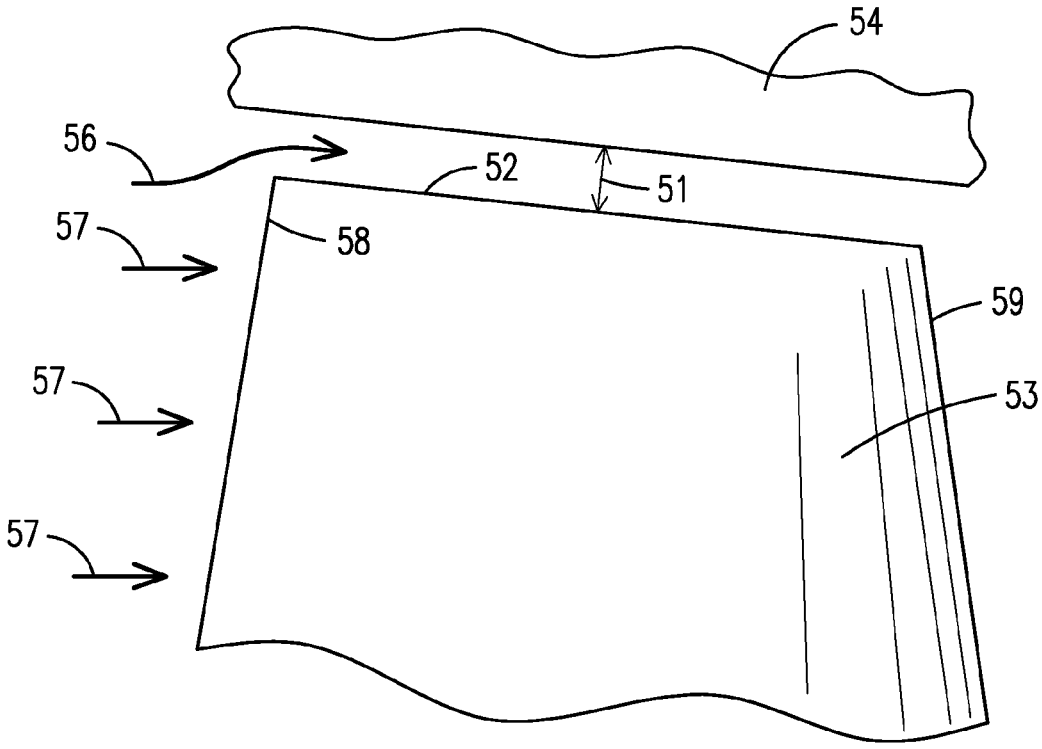
FIG. 3 is a schematic illustration of a cross section of a rotating blade tip region including a blade tip and a compressor cylinder of the axial flow compressor.

As illustrated in FIG. 3, a clearance gap 51 exists between the tip 52 of the rotating blade 53 and a compressor casing wall 54. The clearance gap 51 is a primary source of tip leakage flow 56 between a high pressure side of the blade 53 and a lower pressure side that is caused by a pressure gradient arising between a blade suction surface (the low pressure side) and a blade pressure surface (the high pressure side). The physics of the interaction between the tip leakage flow 56 and a main passage flow 57 causes the tip leakage flow 56 to "roll up," tending to create a tip leakage vortex. The tip leakage vortex is a three-dimensional vortical structure that produces irreversible losses in work as well as an increase in blade loading at the tip 52. Thus, the interaction between the tip leakage flow 56 and the main passage flow 57 results in a loss or a reduced efficiency of the compressor.

Figure 4:
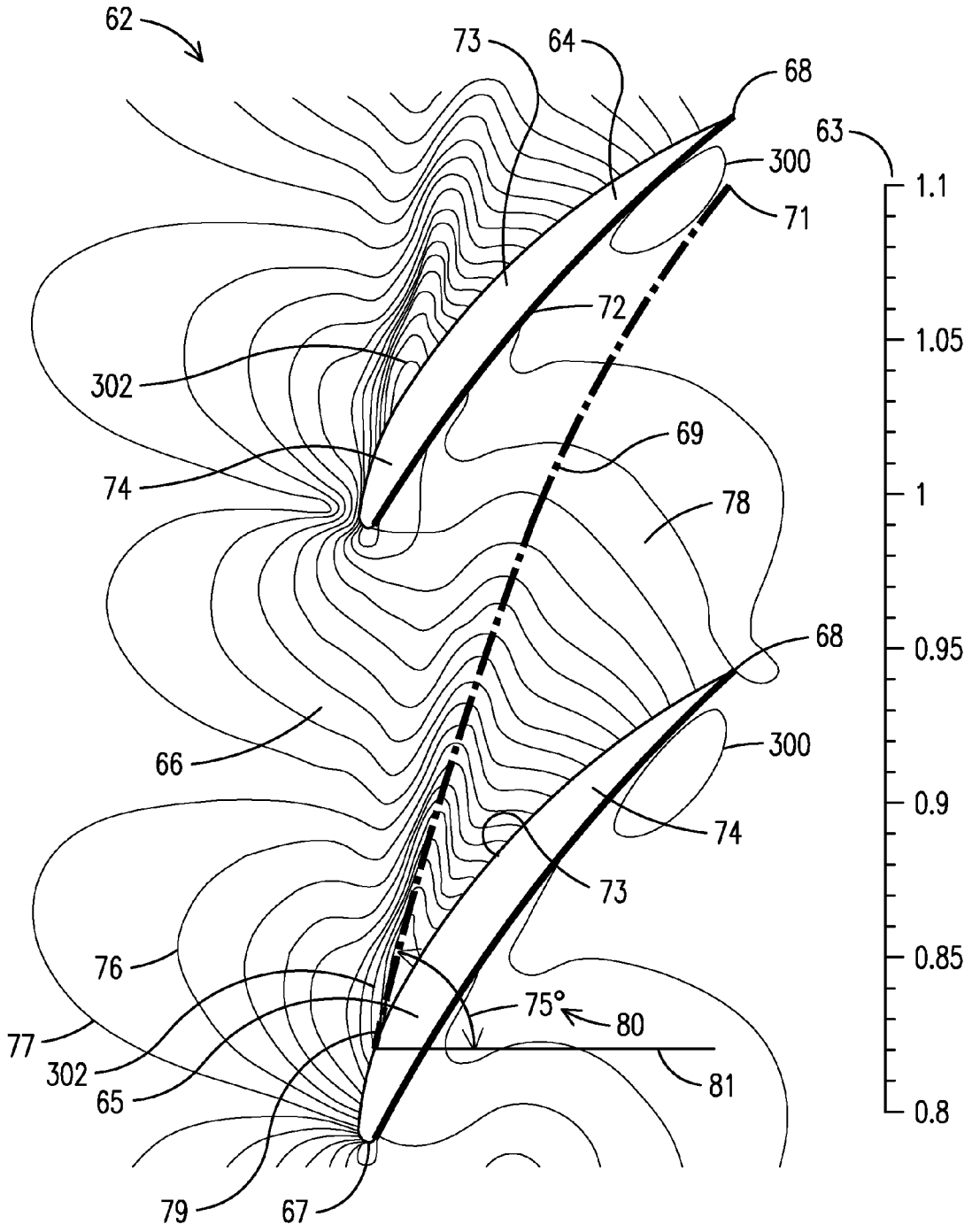
FIG. 4 is a contour plot illustrating a ratio of the static pressure at a blade tip of a row of rotating compressor blades to the total pressure at a stage inlet for the blade tip of the row of rotating compressor blades for a compressor casing having a smooth wall and operating at a peak efficiency.

During normal and stable operation, the tip leakage flow 56 generally travels in the axial direction from the leading edge 58 of the blade tip, exiting at the trailing edge 59, and continuing to flow downstream. Visualization of the tip leakage flow is illustrated in FIG. 4, which is a contour plot 62 of a pressure ratio 63 of the tip leakage flow at peak efficiency at the tip region 74 of the rotating row of blades with two adjacent blades 64, 65 in the row depicted. The pressure ratio 63 is the ratio of the static pressure to the total inlet pressure and is an indication of fluid flow through a throat 66 between the two adjacent blades 64, 65. Generally, it is more difficult for fluid to flow in regions having a higher pressure ratio 63. This is because a higher pressure creates an aerodynamic "blockage" near the casing wall, disrupting the main flow and negatively impacting the compressor performance. Contour line 300 corresponds to the region having a peak pressure ratio, and is approximately 1.1. A region having a low pressure ratio often indicates the fluid flow is choked. Contour line 302 corresponds to the minimum pressure ratio, and is approximately 0.8. The pressure ratios increase from the minimum value at contour line 302 to a maximum value at contour line 300 and may increase or decrease in either a linear or non-linear fashion. Choked flow is a limiting condition that occurs when the mass flow will not increase with a further decrease in the downstream pressure while upstream pressure is fixed. Contour lines, for example 76, 77, which are about 1.0 and 0.99, respectively, are illustrated on plot 62 and are a visualization tool to aid the analyst in evaluating the flow field. Additionally, information such as a pressure gradient can be obtained from the plot 62. The pressure gradient is a measure of the spacing between the contour lines and indicate the rate at which the pressure ratio is increasing (lines spaced closely together) or decreasing (lines spaced farther apart). Regions on the plot 62 having a high pressure gradient, such as near the leading edge 67 of the blade 65, are where contour lines are closer together and regions on the plot 62 having a lower pressure gradient, such as in the throat between the blades near the trailing edge 78, are where the contour lines are spaced farther apart. Regions where the pressure gradient is high are indicative of the tip vortex structure. Regions of low static pressure indicate the vortex, and regions of high static pressure indicate that the vortex has broken down and stagnated. It is these regions of high static pressure that would benefit from the placement of the circumferential groove. A tip clearance vortex 79 is seen near the leading edge 67 of the blade, and has formed on a suction surface 73. Formation of the tip clearance vortex 69 can occur during normal operation of the compressor and result from the tip leakage flow between the rotating blade tip and the casing wall. As can be seen, the tip clearance vortex 79 has a trajectory 69 that extends from near the leading edge 69 of the first blade 65 and between the first blade 65 and the adjacent blade 64 in the throat 66 and is the path of the tip clearance vortex 79. A trajectory exit 71 is proximate the pressure surface 72 near the trailing edge 68 of the adjacent blade 64. In aerodynamic design, the trajectory 69, as illustrated, is a typical trajectory when the compressor is operating at, or very near, a design point (see FIG. 1). Therefore, it is an aerodynamic design objective of the analyst to have a pressure ratio for a tip leakage flow at the tip region of a blade and a tip clearance vortex trajectory similar to the tip leakage flow and trajectory as illustrated in FIG. 4, which shows tip leakage flow having a trajectory of a tip clearance vortex that extends from the leading edge of the first blade, through the throat between the adjacent blades, and exits at the trailing edge of the adjacent blade. Furthermore, it is preferable to have the tip clearance vortex 79 form at a location on the blade pressure surface 81 and greater than at least 5% of a blade chord, when measured from the leading edge of the blade 65.

Figure 5:
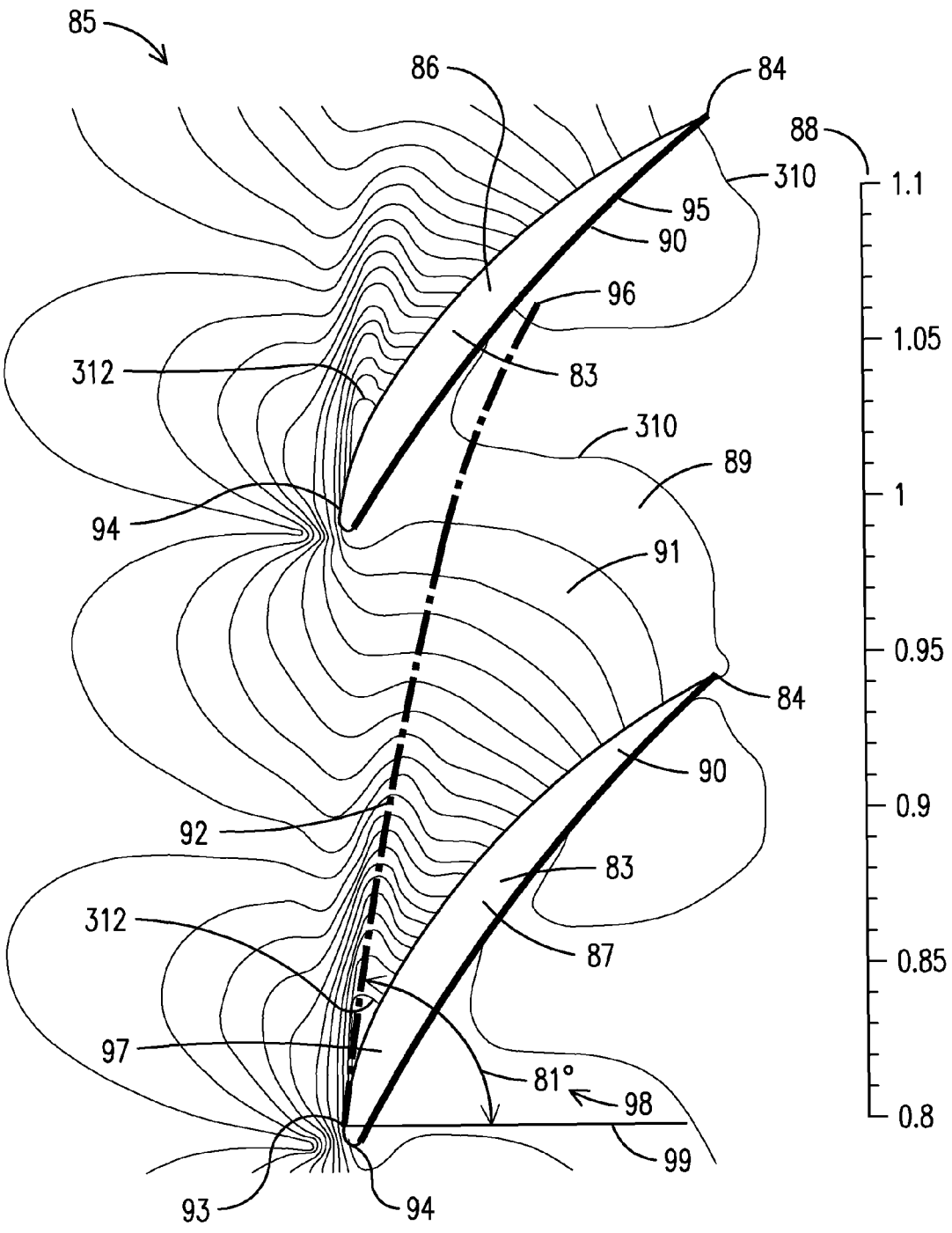
FIG. 5 is a contour plot illustrating a ratio of the static pressure at a blade tip of a row of rotating compressor blades to the total pressure at a stage inlet for the blade tip of the row of rotating compressor blades for a compressor casing having a smooth wall and operating in a rotating stall condition.

As previously discussed, when the compressor is operating at an off-design point (see FIG. 1), there is a likelihood that a rotating stall will occur. Also recall, rotating stall results in a localized region of reduced or reversed flow that rotates around the annulus of the flow path and through the compressor. Turning now to FIG. 5, a contour plot 85 is illustrated of the pressure ratio 88 of a tip region 83 of two adjacent blades 86, 87 in a rotating row of blades. In FIG. 5, the pressure ratio 88 is generally higher when compared to the pressure ratio 63 illustrated in FIG. 4. More particularly, the pressure ratio 88 is generally higher in an exit region 89 and towards the trailing edge 90 of the blades 86, 87 and in a throat 91 between the adjacent blades 86, 87. A peak pressure ratio corresponds with contour line 310 and a minimum pressure ratio corresponds with contour line 312. The pressure ratios decrease along contour lines moving from the peak pressure ratio contour 310 to the minimum pressure ratio contour 312. A higher pressure ratio 88 in the exit of the throat 89 can be thought of as a blockage for the fluid flow. This can lead to a stagnation of the fluid flow at the blade tip, and further, to a reversal of flow at the tip of the rotating blade.

Figure 6:
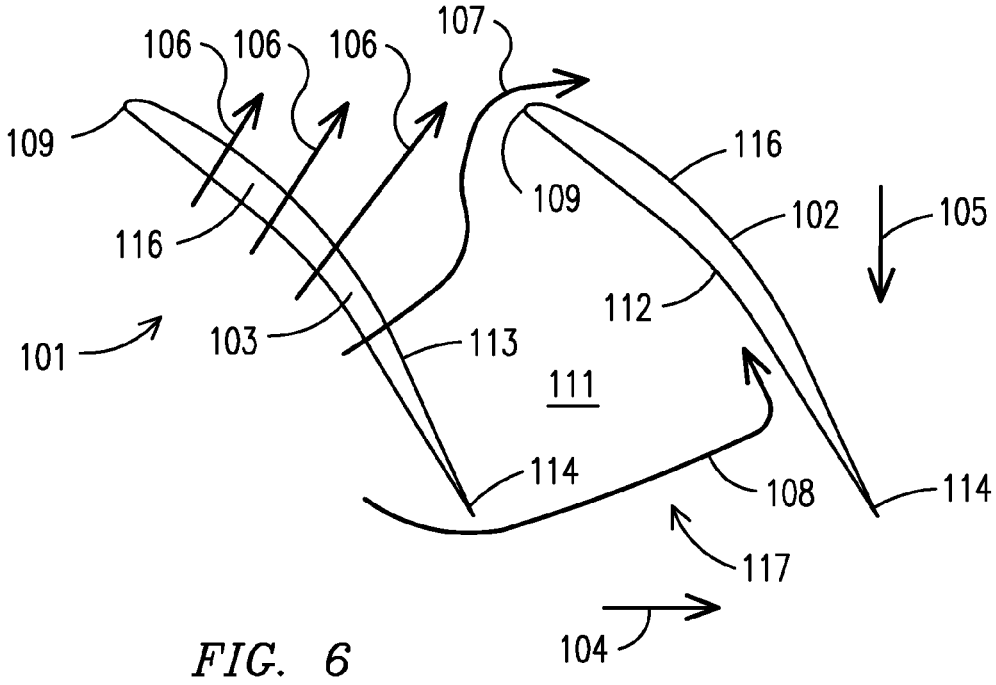
FIG. 6 is a vector plot of the tip flow leakage for the row of rotating compressor blades at the blade tip for a compressor casing having a smooth wall and the compressor operating in a rotating stall condition.

The phenomenon of flow reversal is more clearly illustrated in FIG. 6, which is a vector plot 11 of fluid flow in the tip region of adjacent blades 102, 103 with the compressor operating in rotating stall. For clarity, the blades 102, 103 are rotating in the tangential direction 104 and the fluid is flowing in the axial direction 105. The velocity of the fluid flow is represented by a plurality of flow vectors 106-108, which are flowing over the blade tip 116 from the suction surface 113 of the first blade 103 generally toward the pressure surface 112 of the adjacent blade 102. The vectors 106 are proximate the leading edge 109 of the blade 103, and are moving in a direction opposite the axial direction 105 of fluid flow. Flow vector 107, which travels from approximately mid-chord of the first blade 103 towards the leading edge 109 of the adjacent blade 102, turns in a curved path around the leading edge 109 of the adjacent blade. Flow vector 108 travels from the trailing edge 114 of the first blade 102 across a throat 111 between the blades 102, 103 and approaches the pressure side 112 of the adjacent blade 102 before turning upstream (a direction opposite the axial direction of flow 105). The reversal of vectors 107, 108 is the result of a region of high pressure in an exit region 117 causing the "blockage" and preventing fluid from flowing toward the exit 117. If the tip leakage flow 106-108 were not experiencing rotating stall, the flow vectors 106-108 would be directed downstream 105, extending from the suction surface 113 of the first blade 103 toward the exit region 117 through the throat 111 between the adjacent blades 102, 103. The reversal of fluid flow in part leads to the loss in efficiency and is caused by the high pressure ratio, which produces an aerodynamic blockage as discussed in connection with FIG. 5.

Returning to FIG. 5, when the compressor is experiencing rotating stall, the trajectory 92 of the tip clearance vortex 93 originates at the suction surface 97 of the leading edge 94 of the first blade 87 and is directed across the throat 91 toward the pressure surface of the adjacent blade 96. However, the tip clearance vortex 93 originates closer to the leading edge 94 of the first blade 87 when compared to that of FIG. 4. Generally, rotating stall can be visualized as a two-dimensional phenomena that results in the localized region of reduced or reversed flow (see FIG. 6), which rotates around the annulus of the flow path. The stalled airfoils create pockets of relatively stagnant air, which, rather than moving in the flow direction, rotate around the circumference of the compressor or flow in the reverse direction. The stagnant air rotates with the rotor blades but at 50%-70% of their speed, affecting subsequent airfoils around the rotor as each encounters the stagnant air. As illustrated, the trajectory end 96 intersects the pressure surface 95 of the adjacent blade 86 and leaves the leading edge of first blade 87 at a higher trajectory angle 98 (for this example, 81°) relative to a horizontal line 99 when compared to a trajectory angle 80) (75°) measured relative to a horizontal line 81 of FIG. 4. A lower trajectory angle is also an indication that the tip flow is stable and the compressor not in the regime of rotating stall.

Figure 7:
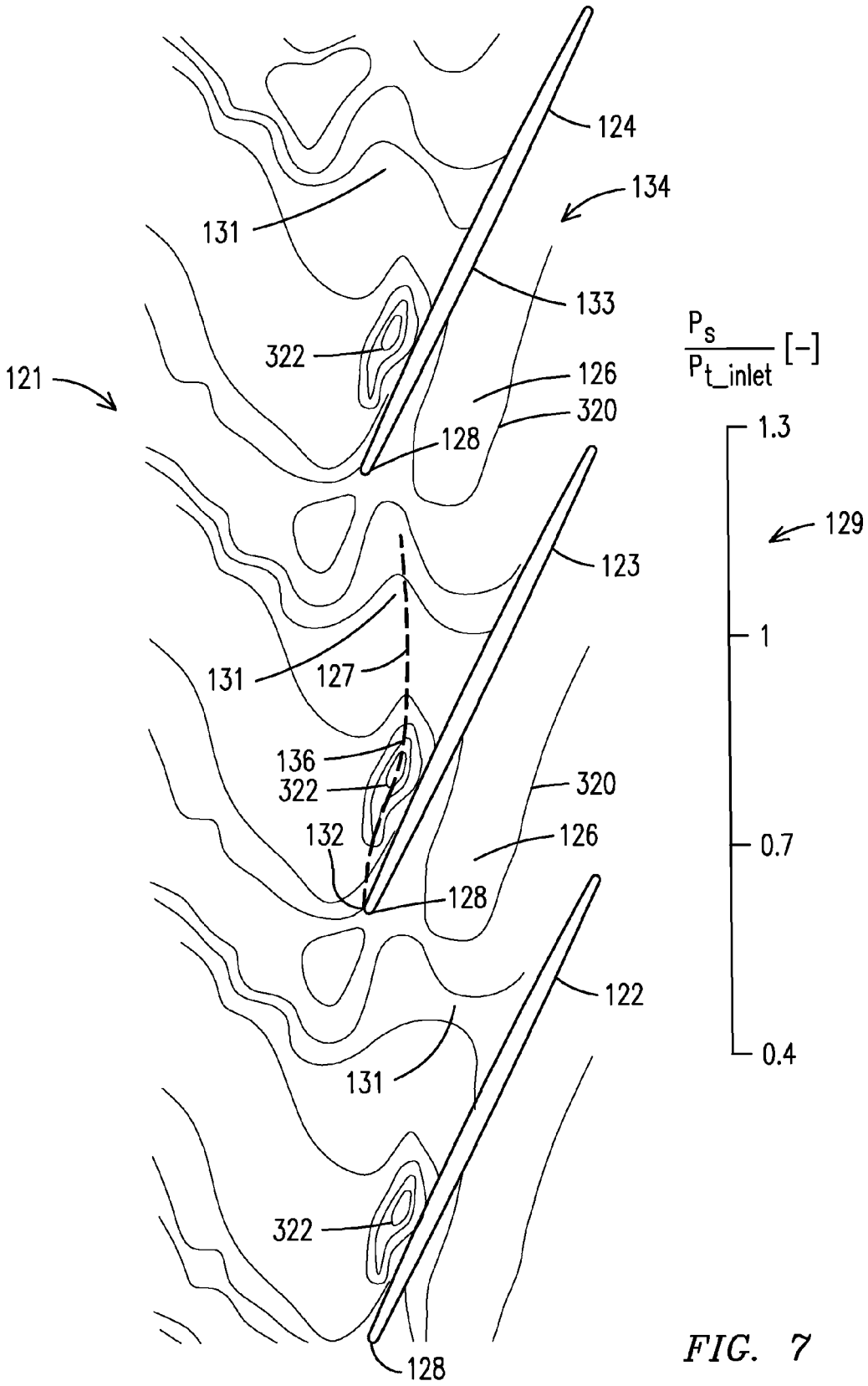
FIG. 7 is a contour plot illustrating the ratio of the static pressure at a blade tip of a row of rotating compressor blades to the total pressure at a stage inlet for the blade tip of the row of rotating compressor blades for a compressor casing having a smooth wall and operating under a rotating stall condition.

FIG. 7 is another contour plot of the pressure ratio 129 (measured as static pressure, $P_s$, divided by total pressure, $P_t$) at the tip region of three adjacent rotating compressor blades 122, 123, 124 evaluated with a smooth compressor casing and is provided to further illustrate the condition of rotating stall. Contour lines 320 having a peak pressure ratio of about 1.3 and contour lines 322 having a minimum pressure ratio of about 0.4 are illustrated. As in FIG. 5, a region 126 having a high pressure ratio exists in a throat 131 between adjacent blades. The tip clearance vortex 132 originates at the leading edge 128 of the tips of blades 122, 123, 124. The tip clearance vortex trajectory 127 is seen to extend from the leading edge 128 of the blade 123 toward the pressure surface 133 of the adjacent blade 124. The region 126 of high pressure ratio 129 is acting to block fluid flow and prevent the trajectory 127 of the tip clearance vortex 132 from flowing downstream toward an exit region 134, which is located between the adjacent blades 123, 124. The trajectory 127 has a bend 136, which is where the trajectory turns and becomes more parallel with the circumferential direction, and indicates stalled flow.

Figure 8:
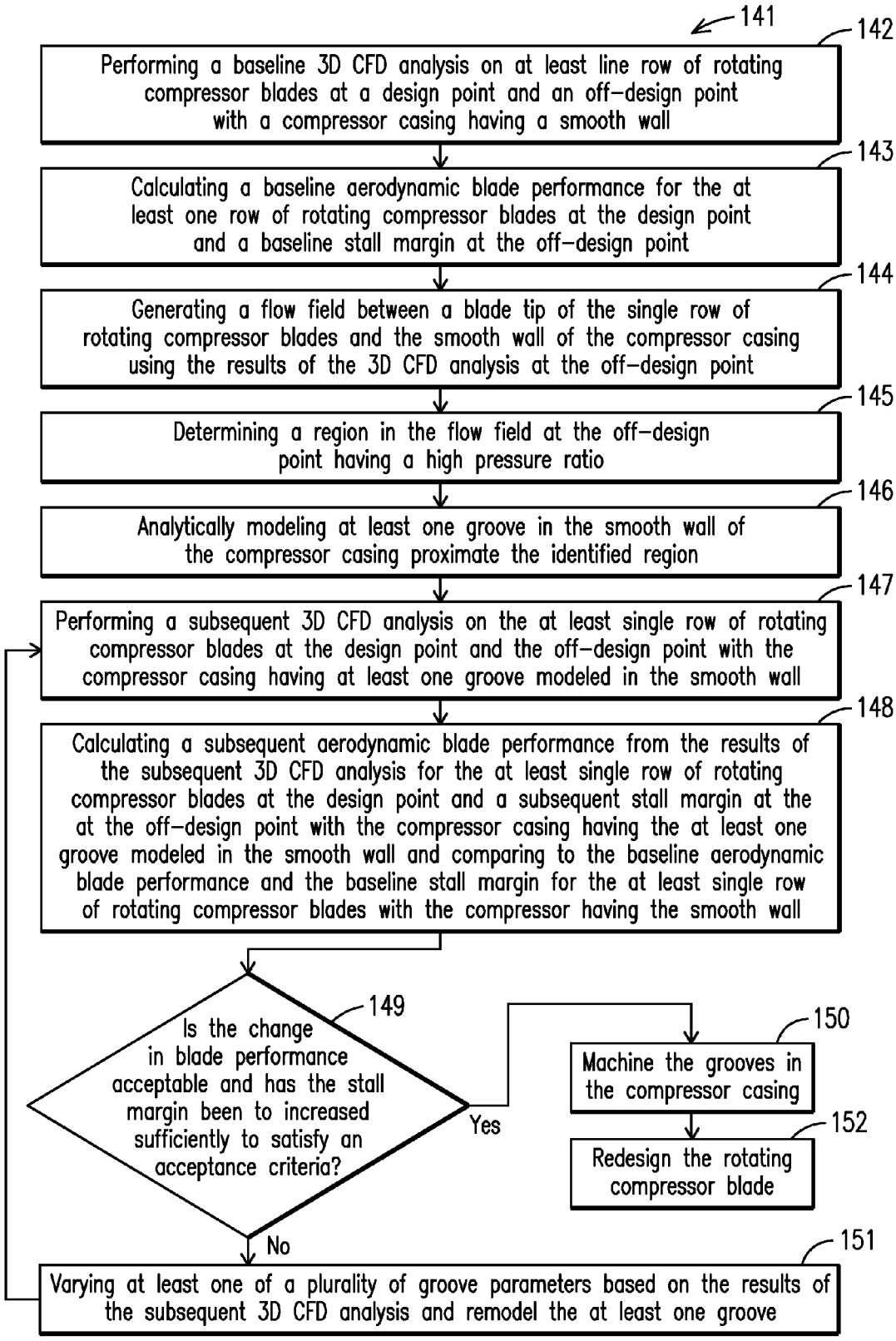
FIG. 8 is an illustration of a flowchart diagram for an exemplary method for determining a casing treatment groove arrangement of the present invention.

Turning now to FIG. 8, wherein a method 141 for determining the placement of at least one circumferential groove in a wall of a compressor casing is discussed. Initially, a determination is made as to which rows of rotating compressor blades will be evaluated. It will be understood by those skilled in the art that the disclosed method is not limited to any one particular row of rotating blades within the compressor but applicable to all rows of rotating blades within the compressor. Generally, a casing treatment, or machining circumferential grooves into the smooth wall of the compressor casing, is applied to the compressor casing above the fan blades, the row one compressor blades, the row two compressor blades, or combinations thereof.

Figure 1:
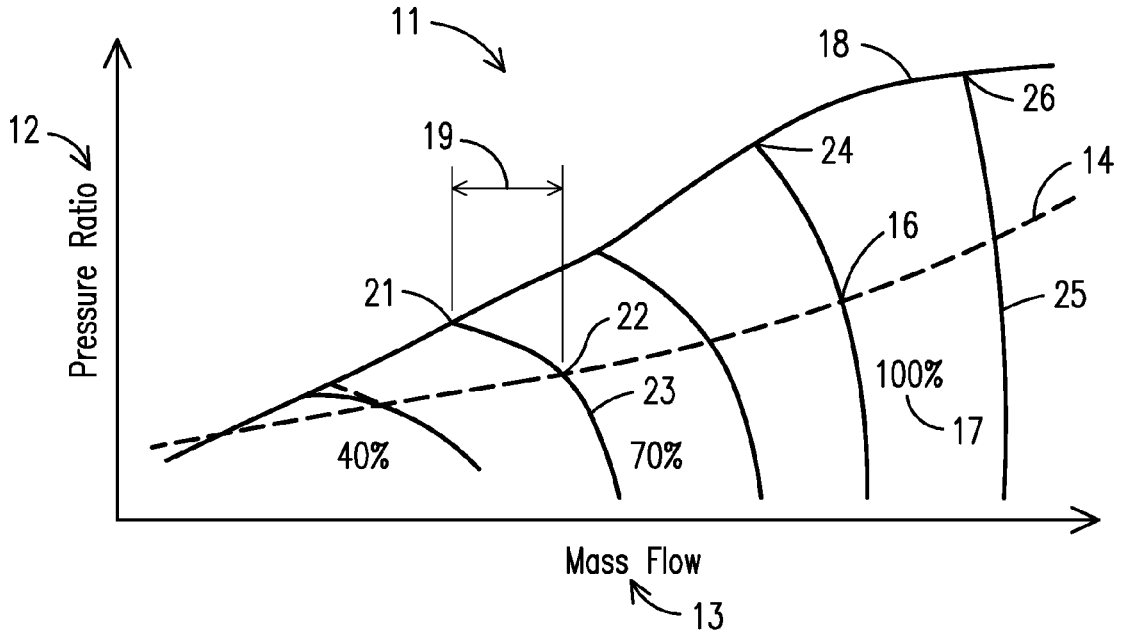
FIG. 1 is a compressor map of an exemplary axial flow compressor showing the pressure ratio as a function of mass flow through the compressor.

Once the row, or rows, of rotating blades have been identified for analysis, a baseline blade performance is calculated. To evaluate the baseline of the rotating compressor blades, a baseline 3D CFD analysis is performed on the selected row(s) of rotating compressor blades at a design point and an off-design point, with the compressor casing having a smooth wall and is a initial step 142 of the method 141. The 3D CFD analysis can be performed with any computational fluid dynamic software package, and several examples of acceptable software packages that are commercially available are Fluent, CFX, Fine/Turbo, or STAR-CD. As shown in FIG. 1, there are many off-design points to select from for evaluation and the off-design point near the expected stall point at the lowest operating speed 21 should be selected for evaluation. The 3D CFD analysis can, at a minimum, include developing an analytical model of the compressor blade and an analytical model of the casing wall, applying the appropriate boundary and flow conditions, and solving with the use of the 3D CFD software analysis tool including viscous effects of the fluid.

As illustrated in FIG. 8, calculating a baseline blade performance for the row of rotating blades is a second step 143 of the method 141. The baseline performance analysis includes calculating a baseline aerodynamic blade performance for the compressor blades at the design operating point and calculating a baseline stall margin of the compressor blades at the off-design operating point. If desired, the aerodynamic performance can be calculated via a two dimensional steady state analysis of the blades, but it is preferred to perform the analysis using a 3D CFD analysis because of the increased level of detail available from the 3D CFD analysis.

In a third step 144 of the method 141, a flow field at the tip region of the blades is generated from the results of the baseline 3D CFD analysis of the row of blades at the off-design point. The flow field is typically illustrated as a contour plot showing the ratio of the static pressure to the total inlet pressure (for example, see FIGS. 4, 5, and 7) or simply, the pressure ratio. The flow field may be represented in other forms, such as a tabulation of the numerical results, graphically, or a plot illustrating the topography and it is left to the discretion of the analyst how to best represent the results for the easiest and most precise interpretation.

The analyst will carefully interpret the contour plot to identify regions having a high pressure ratio for placement of at least one circumferential groove and is a fourth step 145 of the method 141. Regions with high pressure ratios are preferred locations for the placement of the at least one circumferential groove in the smooth wall of the casing. Placing the at least one circumferential groove in the smooth wall of the casing functions to reduce the high pressure ratio at the groove location and promote the tip leakage flow to move in a circumferentially around the annulus thereby reducing the loading on the rotating row of blades because the stall cell will be dissipated. This will also increase the stall margin. Recalling from FIG. 5, region 89 is a region in the throat having a high pressure ratio and would be the preferred location for placement of at least one groove for a subsequent 3D CFD analysis. Generally, placement of the at least one circumferential groove should be between the leading edges 94 and trailing edges 84 of the blades 86,87, in the axial direction. Initially, the at least one groove depth will depend on the pressure ratio. For example, a location having a high pressure ratio would require a greater groove depth and this relationship is directly proportional.

Placement of the at least one circumferential groove is not trivial. The center of the first circumferential groove can be at the location of the peak pressure ratio and as near the trailing edge of the blade in an axial direction as possible without extending beyond the trailing edge, at the blade tip, of the blade. The groove depth and groove width of the first circumferential groove are selected based on the flow field and peak pressure ratio. The groove depth and width are set as a fraction of the airfoil chord, not in absolute size, because the size of fans and compressors differs. A typical first groove would have a width of 5% of blade chord and depth of half the width. As mentioned above, groove width and groove depth are a function of the pressure ratio of the flow field. Additionally, it is understood that compressor rotor growth in the axial direction due to thermal expansion and thrust are accounted for with physical placement in the casing of the at least one circumferential groove. If the pressure ratio of flow field requires subsequent circumferential grooves, the subsequent circumferential grooves are spaced in the axial direction upstream from the first circumferential groove and the subsequent adjacent circumferential grooves are spaced for a sufficient ligament between grooves. The groove depths of subsequent adjacent grooves (moving in an axial direction from trailing edge to leading edge) will become more shallow, with the last groove in a groove arrangement, i.e. a plurality of circumferential grooves, being the shallowest. As with the first circumferential groove, it may be desirable to have the last circumferential groove should not extend beyond the leading edge, at the blade tip, of the blade, although it is not required.

The preferred embodiment is not a single circumferential groove but a groove arrangement comprising a plurality of circumferential grooves, which is an improved means of adjusting the trajectory of the tip clearance vortex and increasing the stall margin. The negative impact the groove arrangement will have on compressor performance can be reduced because less casing material is removed with the more shallow grooves, thereby reducing the leakage flow area.

Returning to FIG. 8, a fifth step 146 of the method 141 is to analytically model the at least one circumferential groove into the smooth wall of the compressor casing at the location, or locations, identified as having a high pressure ratio. A sixth step 147 of the method 141 is to perform the subsequent 3D CFD analysis at the design point and the off-design point of the analytical model comprising the at least one circumferential groove modeled into the casing.

Figure 9:
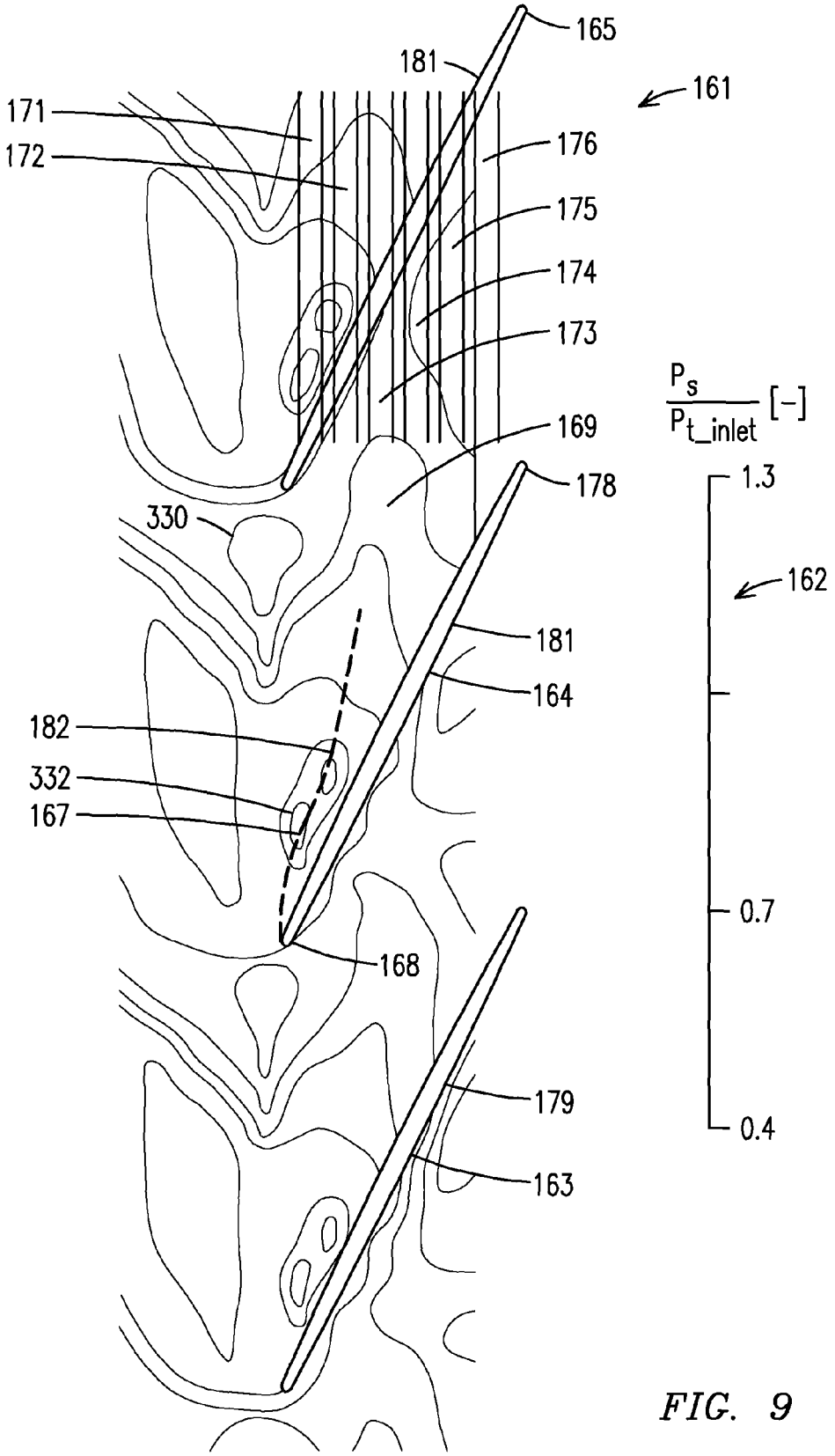
FIG. 9 is a contour plot illustrating a ratio of the static pressure at a blade tip of a row of rotating compressor blades to the total pressure at a stage inlet for the blade tip of the row of rotating compressor blades for a compressor casing having a casing treatment.
Figure 10:
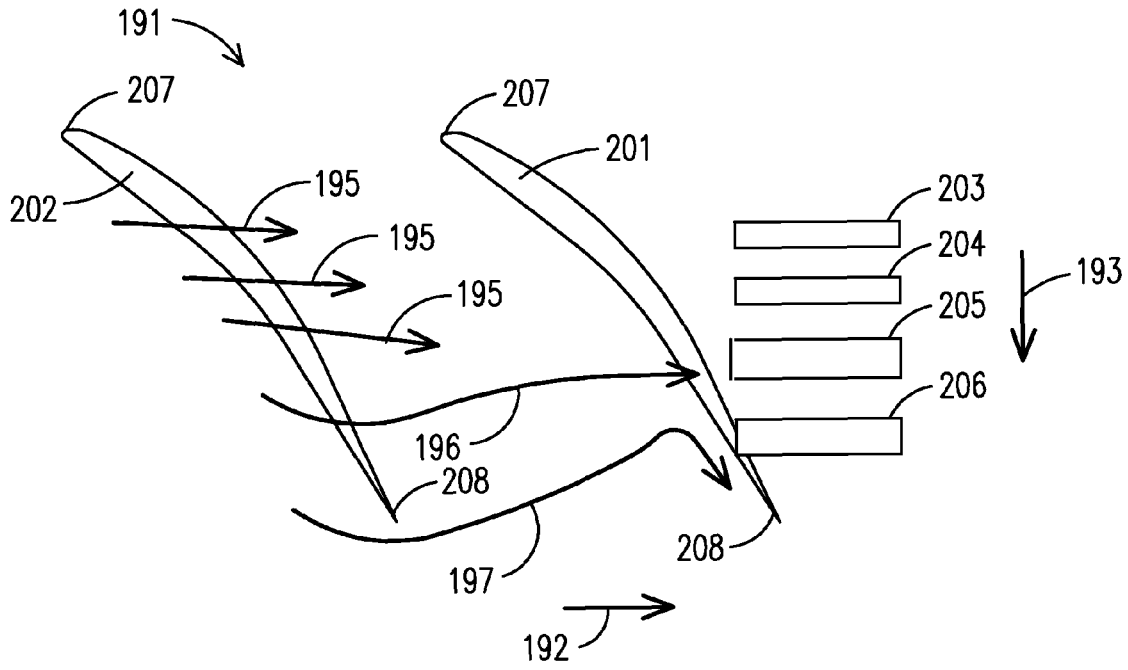
FIG. 10 is a vector plot of the tip leakage flow and the effect that placing at least one circumferential groove in the casing has on the tip leakage flow for the row of rotating compressor blades.

Step seven 148 of the method 141 requires calculating a subsequent aerodynamic blade performance from the results of the subsequent 3D CFD analysis for the at least single row of rotating compressor blades at the design point and a subsequent stall margin at the off-design point and compare the results to the baseline aerodynamic blade performance and the baseline stall margin, respectively. The effect placing the at least one circumferential groove in the casing is illustrated in FIGS. 9 and 10. FIG. 9 is an exemplary contour plot 161 illustrating a pressure ratio 162 (measured as static pressure, $P_s$, divided by total pressure, $P_t$) at a blade tip 179-181 of three adjacent rotating blades 163-165 in a row of rotating blades and a compressor casing having a casing treatment, i.e. a plurality of circumferential grooves 171-176 modeled in the compressor casing. Contour line 330 has a peak pressure ratio of about 1.2 and contour line 332 having a minimum pressure ratio of about 0.4 are illustrated. The pressure ratio decreases along contour lines when moving from contour line 330 to contour line 332. The off-design point evaluated in FIG. 9 is the same off-design point as evaluated in FIG. 7 with the difference between the analysis of FIG. 9 and FIG. 7 being a plurality of circumferential grooves 171-176 modeled in the casing. As seen in FIG. 9, the circumferential grooves 171-176 lower the peak pressure ratio in the region 169 when compared to the same region 126 of FIG. 7. Furthermore, a trajectory 168 of the tip clearance vortex of FIG. 9 is adjusted to move downstream, toward the trailing edge 178 of the rotating blade 164 when compared to the same of FIG. 7. The trajectory 168 has bend 182, which is similar to the bend 136 of FIG. 7, but bend 182 is not as sharp as bend 136, indicating that the tip clearance vortex of FIG. 9 is directed more downstream than the tip clearance vortex of FIG. 7. The reduction in pressure ratio 162 and the redirecting of the trajectory 167 of the tip clearance vortex result from the circumferential grooves 171-176 in the casing. Recall from FIG. 4 the trajectory 69 of the tip clearance vortex for the case of peak performance. It is noted that the trajectory 167 of FIG. 9 is improved in the sense that it more closely resembles. in direction, the trajectory 69 of FIG. 4; moving downstream and through the throat 131 between adjacent blades 164,165. With the reduction in pressure ratio 162 and the trajectory 167 directed more downstream, there will be an increase in stall margin. However, there will be a penalty in aerodynamic blade performance because the volume of leakage flow will increase as a direct result of the casing material removed from machining the circumferential grooves into the casing above the blade tips.

Figure 11:
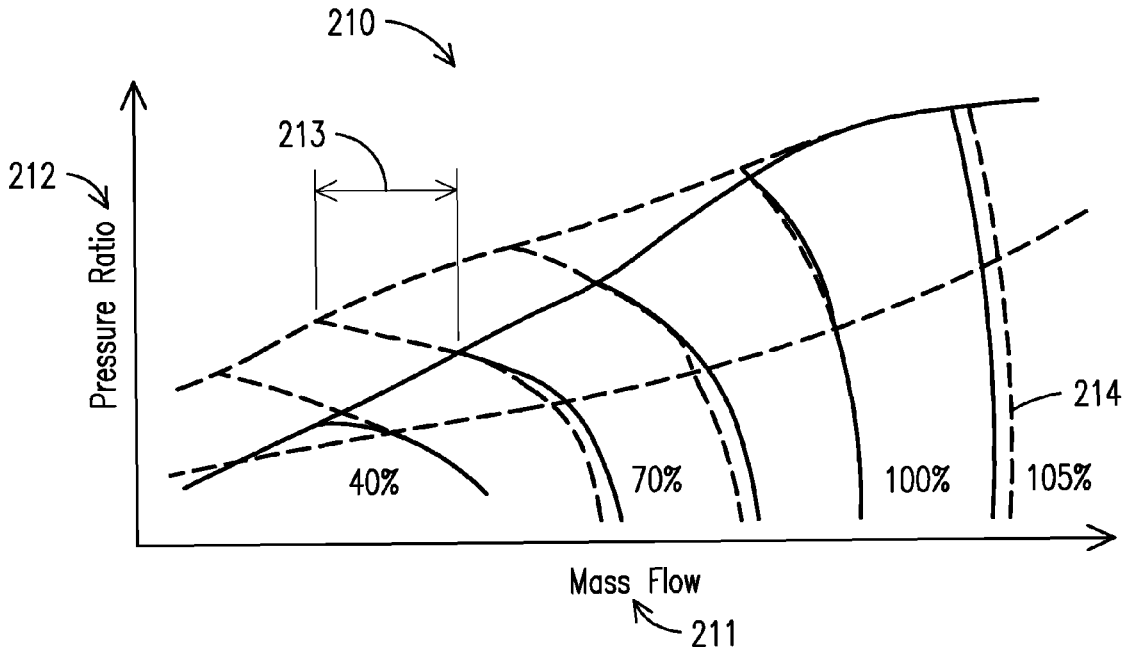
FIG. 11 is a graph showing the increase in pressure ratio of an exemplary axial flow compressor as a function of mass flow through the compressor and the increase in stall margin with the use of the casing treatment.

FIG. 10 is an illustration of a vector plot of the tip leakage flow and the effect that placing at least one circumferential groove in the casing has on the tip leakage flow for the row of rotating compressor blades when the compressor is operating at an off-design point. The off-design point evaluated in FIG. 10 is the same off-design point as evaluated in FIG. 6, with the difference between the analysis of FIG. 10 and FIG. 6 being a plurality of circumferential grooves modeled in the casing for the analysis in FIG. 10. As seen in FIG. 10, a plurality of circumferential grooves 203-206 are arranged in the casing above the rotating blades 201, 202 and between the leading edge 207 and the trailing edge 208 of the blades 201, 202. The direction of rotation of the blades 201, 202 is in the circumferential direction 192. The plurality of grooves 203-206 vary in groove width, with the widest grooves 205, 206 arranged closer to the trailing edge 208 of the blades 201, 202 where the pressure ratio is higher. The wider circumferential grooves 205, 206 are also deeper than grooves 203, 204 having a greater cross sectional area and able to transport fluid having a higher pressure ratio circumferentially around the compressor annulus. Velocity of the fluid flow is represented by a plurality of velocity vectors 195-197. The vectors 195-197 correlate with the vectors 106-108 of FIG. 6. It can be seen that vectors 195-197 of FIG. 10 are oriented more towards the downstream direction 193 when compared to the vectors 106-108 of FIG. 6. Furthermore, the flow reversal as seen by vector 108 of FIG. 6 has been eliminated with the application of the circumferential grooves 203-206 of FIG. 10 and is shown by vector 197. Thus, the application of circumferential grooves 203-206 of the casing treatment promotes fluid flow more in the downstream direction 193 and eliminates the flow reversal as seen in FIG. 6 to increase stall margin of the rotating blades. With reference to FIG. 11, which is a compressor map 210 showing pressure ratio 212 plotted as a function of mass flow 211, the increase in stall margin 213 as a result of the casing treatment is presented graphically. Furthermore, the casing treatment can allow for operation at an increased mass flow over the compressor having no casing treatment. This is beneficial because there is an increase in power output of the gas turbine engine when a greater mass flow can be moved through the compressor. A further benefit is an increase in the operating range at part speed or reduced speed conditions.

Returning to FIG. 8, step eight 149 of the method 141 is assessing the change in aerodynamic blade performance of the subsequent aerodynamic blade performance when compared to the baseline aerodynamic blade performance and assessing the change in the stall margin of the subsequent stall margin when compared to the baseline stall margin. An acceptance criteria for the change in aerodynamic blade performance and change in stall margin is established. As previously discussed, the change in aerodynamic blade performance can benefit negatively from the casing treatment and the change in stall margin can benefit positively from the casing treatment. An acceptable increase in stall margin is at a minimum an increase of 5% in stall margin and an acceptable decrease in aerodynamic blade performance is no more than 1% in aerodynamic blade performance. The acceptance criteria can depend on the type of gas turbine engine, the desired performance characteristics of the gas turbine engine, and the duty cycle of gas turbine engine, to name but a few. If the acceptance criteria is satisfied, the circumferential groove geometry as evaluated in step seven 148 is machined into the casing, as indicated in step 150. If the acceptance criteria has not been met, then the method 141 proceeds to step 151, where at least one of a plurality of groove parameters is adjusted based on the results of the subsequent 3D CFD analysis performed in step six 147 and the adjusted at least one circumferential groove is analytically modeled into the casing and a subsequent 3D CFD analysis performed. Steps 147-151 are iterated upon until the acceptance criteria of step 149 is satisfied and the groove profile can be machined into the casing, as indicated in step 150. The groove profile that satisfies the acceptance criteria is considered to be the preferred groove profile and is but one of many groove profiles or groove arrangements.

Figure 12:
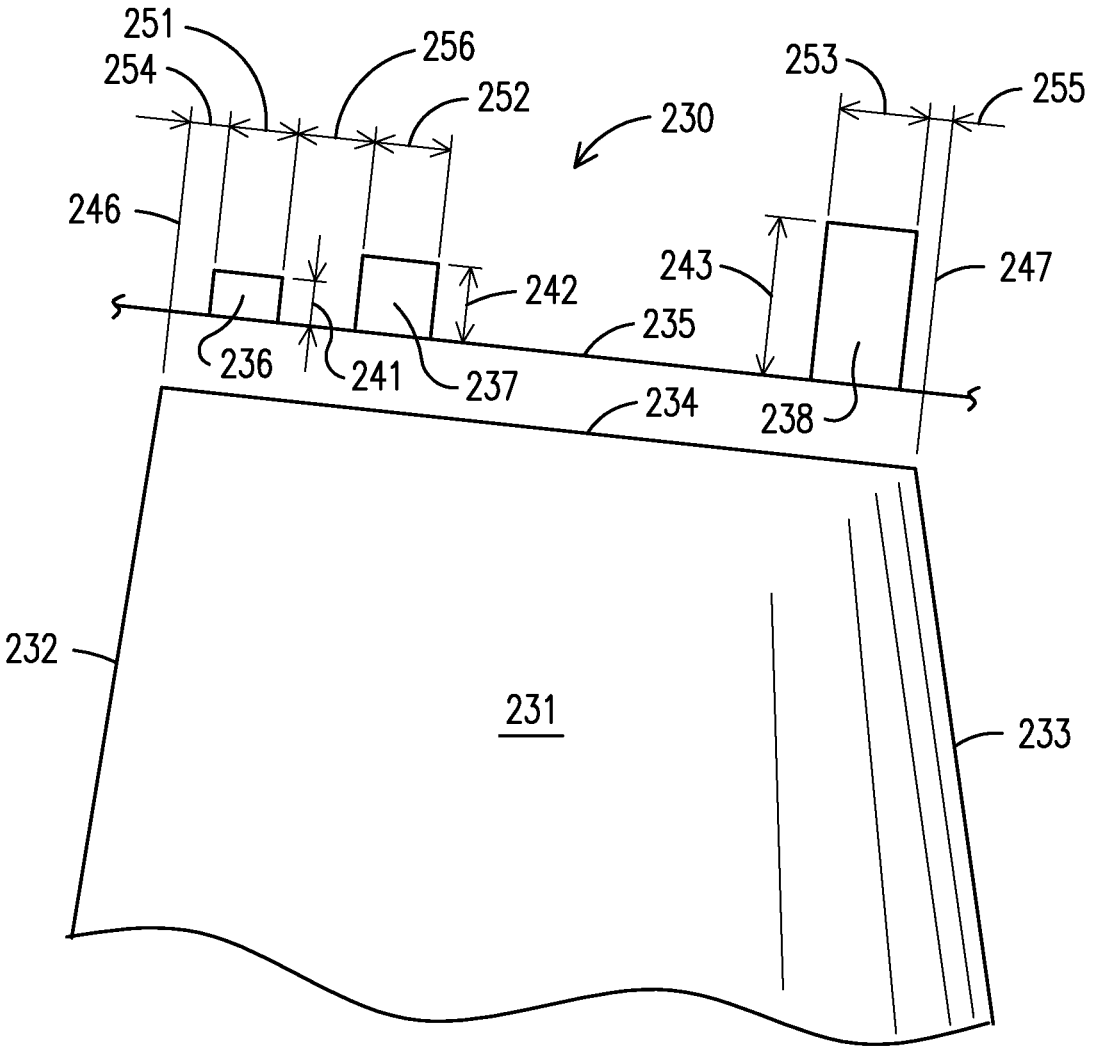
FIG. 12 is a cross sectional illustration of an arrangement of casing grooves of a casing treatment identifying various design parameters of the groove arrangement.

FIG. 12 is a cross sectional illustration of an arrangement of casing grooves 230 of a casing treatment identifying various design parameters of the groove arrangement 230 for a given row of compressor blades. A portion of a rotating blade 231 is illustrated, having a leading edge 232, a trailing edge 233, and a blade tip 234. Arranged above the blade tip 234 is a casing wall 235 having a plurality of grooves 236-238 arranged within. As illustrated, the groove arrangement 230 is comprised of three grooves 236-238. However, as the skilled artisan will recognize, the groove arrangement 230 can be comprised of more grooves or fewer grooves and can depend on the flow field for the particular blade (see e.g. FIGS. 4, 5, and 7). Thus, the total number of grooves that comprise the groove arrangement 230 is a groove parameter. Grooves 236-238 each have a respective groove width 251-253 and a respective groove depth 241-243. The groove width and the groove depth are also groove parameters. For the illustrated groove arrangement 230, successive grooves, when moving from the leading edge 232 to the trailing edge 233, are illustrated as increasing in groove depth 241-243, which is the preferred embodiment. An increasing successive groove depth 241-243 will more closely accommodate a typical pressure ratio distribution as seen in a blade tip region when the compressor is experiencing rotating stall. A deeper groove 238 can be placed in the casing where the pressure ratio is highest and a more shallow groove 236 can be placed in the casing where the pressure ratio is not as high. Based on the method of FIG. 8, the groove arrangement 230 is designed to have grooves with appropriate groove widths and groove depths to reduce the increase in leakage flow that typically accompanies application of a casing treatment. An axial spacing 256 between adjacent grooves 236, 237 is yet another groove parameter. The axial spacing 256 is not required to be the same between successive adjacent grooves and the axial spacing can be dictated by a required ligament distance, for example 256, for mechanical reasons. For example, the axial spacing 256 between grooves 236, 237 can be different from the axial spacing (not shown) between grooves 237, 238. Yet another groove parameter is a distance 254 from a blade tip leading edge 246 to the first groove 236 and a distance 255 from a blade tip trailing edge 247 to the first groove 238. As illustrated, the cross section of each groove is rectangular. However, it is not required that the cross section be rectangular with many groove cross sections being possible and the groove cross section being largely dependent on machining capabilities. Thus the groove parameters include, but are not limited to: the number of grooves; the groove depth of a groove; the groove width of a groove; the axial spacing between adjacent grooves; the distance from the blade tip leading edge to the first groove; the distance from the blade tip trailing edge to the last groove; the groove cross section; and combinations thereof. The analyst has the freedom to combine as many or as few of the groove parameters as desired to achieve the desired increase in stall margin while trying to minimize the negative impact to aerodynamic blade performance.

Returning to FIG. 8, the rotating blade can be redesigned to capitalize on the increase in stall margin due to the casing treatment, and is step 152 of the method 141. Increasing the stall margin can be used to increase the loading on the rotating blade in order to increase the stage efficiency. The analyst can redesign the rotating blade to increase a blade twist, for example, which is an amount of twisting the blade has in the radial direction. Increasing the twist the blade will allow the blade to better fit the flow field of the main flow thereby increasing the efficiency of the rotating blade and compressor. Thus, redesigning the rotating blade can increase the efficiency of the rotating blade and reduce the negative effect on the aerodynamic performance resulting from the casing treatment.

Accordingly, a method of improving the stall margin of an axial flow compressor is disclosed that addresses successfully the problems and shortcomings of the prior art by providing a means of groove placement in a compressor casing. The method uses results from a 3D steady state CFD analysis to place grooves at the appropriate location having an improved groove profile that reduces leakage flow that normally accompanies implementation of a casing treatment improving stall margin while at the same time reducing aerodynamic losses.

Described herein, in terms of preferred embodiments, are methodologies considered to represent the best mode of carrying out aspects of this disclosure. However, the disclosure should not be construed to be limited by the illustrated embodiments. In fact, a wide variety of additions, deletions, and modifications might well be made to the illustrated embodiments without departing from the spirit and scope of the invention as set forth in the claims.

What is claimed is:

1. A method of improving a stall margin of an axial flow compressor in a gas turbine engine, comprising the steps of:

(a) analytically calculating a baseline performance from a baseline performance analysis for at least one row of rotating compressor blades;

(b) analytically determining a flow field from the baseline performance analysis for the at least one row of rotating compressor blades at a blade tip region and at an off-design point;

(c) analytically modeling at least one circumferential groove in a smooth wall of a compressor casing with a groove placement and a groove geometry determined using a set of results obtained in step (b), wherein operating the compressor with the circumferential groove in a casing wall increases a stall margin of the at least one row of rotating compressor blades;

(d) performing a subsequent analytical performance calculation of the at least one row of rotating compressor blades with the at least one groove analytically modeled in a smooth wall of the compressor casing;

(e) comparing a subsequent performance determined from the subsequent analytical performance calculation to the baseline performance, and a subsequent stall margin determined from the subsequent analytical performance calculation to a baseline stall margin determined from the baseline performance analysis;

(f) determining if a change in the subsequent performance when compared to the baseline performance and a change in the subsequent stall margin when compared to the baseline stall margin satisfies an acceptance criteria;

(g) adjusting at least one of a plurality of groove parameters of the at least one groove and repeating steps (c) through (f) until the change in the subsequent performance to the baseline performance and the change in the subsequent stall margin to the baseline stall margin satisfies the acceptance criteria; and (h) machining a groove profile defined by the plurality of groove parameters in the smooth wall of the compressor casing.

2. The method as claimed in claim 1, wherein step (a) further comprises performing a first three dimensional steady state computational fluid dynamic analysis including viscous effects at a design operating point, performing a second three dimensional steady state computational fluid dynamic analysis including viscous effects for the at least one row of rotating compressor blades at an off-design operating point.

3. The method as claimed in claim 1, wherein step (a) further comprises calculating the baseline performance using a set of results from the first three dimensional steady state computational fluid dynamic analysis and calculating a stall margin from a set of results from the second three dimensional steady state computational fluid dynamic analysis including viscous effects.

4. The method as claimed in claim 1, wherein step (b) further comprises analytically determining the flow field between a blade tip of the at least one row of rotating compressor blades and the smooth wall of the compressor casing from a set of results from the second three dimensional steady state computational fluid dynamic analysis.

5. The method as claimed in claim 1, wherein step (c) further comprises determining a region in the flow field having a high fluid flow leakage in a circumferential direction and modeling the at least one circumferential groove in the casing proximate the region, wherein the region extends from a blade tip leading edge to a blade tip trailing edge and between adjacent blades in the at least one row of rotating compressor blades.

6. The method as claimed in claim 1, wherein the at least one circumferential groove channels the high fluid flow leakage at the blade tip to flow in the circumferential direction and exit from the trailing edge blade tip thereby increasing the stall margin.

7. The method as claimed in claim 1, wherein step (d) further comprises performing a subsequent three dimensional steady state computational fluid dynamic analysis for the at least one row of rotating compressor blades at the design operating point and the off-design operating point with the plurality of grooves analytically modeled in the smooth wall of the compressor casing.

8. The method as claimed in claim 1, wherein step (e) further comprises calculating a subsequent performance of the at least one row of rotating compressor blades using a set of results from the subsequent three dimensional steady state computational fluid dynamic analysis and calculating a subsequent stall margin of the at least one row of rotating compressor blades using the set of results from the subsequent three dimensional steady state computational fluid dynamic analysis.

9. The method as claimed in claim 1, wherein at least two circumferential grooves are analytically modeled and have an increasing groove depth in an axial direction from the leading edge to the trailing edge of the at least one row of rotating blades.

10. The method as claimed in claim 1, wherein the plurality of groove parameters include a number of grooves, an axial spacing between adjacent grooves, a depth of adjacent grooves, a successive increase in groove depth for the number of grooves, an axial distance from the leading edge of the rotating blade to a first groove, an axial distance from the trailing edge of the blade to a last groove, a groove cross sectional shape, and combinations thereof.

11. The method as claimed in claim 1, wherein the acceptance criteria is an increase in stall margin of at least 5%.

12. The method as claimed in claim 11, wherein the acceptance criteria also includes a decrease in aerodynamic performance of the compressor of no more than 1%.

13. The method as claimed in claim 1, wherein the rotating row of compressor blades is either a row of first stage rotating blades, a row of second stage rotating blades, or a row of first stage and a row of second stage rotating blades.

14. The method as claimed in claim 1, further comprising the step of:

(i) redesigning the rotating blade per the increase in stall margin, the redesigned rotating blade being able to withstand a higher mechanical load.

15. A computer-implemented method for creating a groove profile for a gas turbine engine to provide an improved stall margin, comprising:

(a) performing a first three dimensional steady state computational fluid dynamic analysis via computational fluid dynamic software including viscous effects at a design operating point for at least one single row of rotating compressor blades in a multistage compressor and performing a second three dimensional steady state computational fluid dynamic analysis via the computational fluid dynamic software including viscous effects for the at least one row of rotating compressor blades at an off-design operating point, the compressor having a compressor casing having a smooth wall;

(b) calculating an aerodynamic blade performance for the at least one row of compressor blades using a set of results from the first three dimensional steady state computational fluid dynamic analysis and calculating a stall margin for the at least one row of compressor blades using a set of results from the second three dimensional steady state computational fluid dynamic analysis;

(c) generating a flow field between a blade tip of the at least one row of rotating compressor blades and the smooth wall of the compressor casing from a set of results from the second three dimensional steady state computational fluid dynamic analysis;

(d) determining a region in the flow field having a high pressure ratio at the blade tip, the region extending from a blade tip leading edge to a blade tip trailing edge and between adjacent blades in the at least one row of rotating compressor blades;

(e) analytically modeling at least one circumferential groove in the smooth wall of the compressor casing proximate the region, wherein the groove channels the fluid having the high pressure ratio at the blade tip to flow in the circumferential direction with the flow exiting from the trailing edge blade tip and increasing the stall margin;

(f) performing a subsequent three dimensional steady state computational fluid dynamic analysis via the computational fluid dynamic software for the single row of rotating compressor blades at the design operating point and the off-design operating point with the at least one groove analytically modeled in the smooth wall of the compressor casing;

(g) calculating an aerodynamic blade performance of the single row of rotating compressor blades at the design point and a stall margin at the off-design point from the subsequent three dimensional steady state computational fluid dynamic analysis via the computational fluid dynamic software with the grooves analytically modeled in the casing and comparing to the aerodynamic blade performance and stall margin calculated in step (b);

(h) repeating steps (e)-(g), varying at least one of a plurality of groove parameters until a change in stall margin of the at least one row of rotating compressor blades satisfies an acceptance criteria;

(i) creating a groove profile defined by the plurality of groove parameters for the gas turbine engine, wherein the groove profile comprises at least two grooves; and (j) machining the at least two grooves in the smooth wall of the compressor casing.

16. The method as claimed in claim 15, wherein the acceptance criteria is an increase in stall margin of at least 5%.

17. The method as claimed in claim 15, wherein at least two circumferential grooves are analytically modeled and have an increasing groove depth in an axial direction from the leading edge to the trailing edge of the at least one row of rotating blades.

18. The method as claimed in claim 15, wherein the plurality of groove parameters include a number of grooves, an axial spacing between adjacent grooves, a depth of adjacent grooves, a successive increase in groove depth for the number of grooves, an axial distance from the leading edge of the rotating blade to a first groove, an axial distance from the trailing edge of the blade to a last groove, a groove cross sectional shape, and combinations thereof.

* * * * *